US006761248B1

(12) United States Patent
Harbison

(10) Patent No.: US 6,761,248 B1
(45) Date of Patent: Jul. 13, 2004

(54) ADJUSTABLE HEIGHT PLATFORM SUITABLE FOR INSTALLATION ON A VEHICLE

(76) Inventor: N. Gerald Harbison, 4696 E. Hwy. 329, Anthony, FL (US) 32617

( * ) Notice: Subject to any disclaimer, the term of this patent is extended or adjusted under 35 U.S.C. 154(b) by 0 days.

(21) Appl. No.: 10/394,286

(22) Filed: Mar. 24, 2003

Related U.S. Application Data

(63) Continuation-in-part of application No. 09/633,001, filed on Aug. 4, 2000, now abandoned.
(60) Provisional application No. 60/194,365, filed on Apr. 4, 2000, and provisional application No. 60/147,391, filed on Aug. 6, 1999.

(51) Int. Cl.[7] ..... E06C 5/00; E04G 1/18
(52) U.S. Cl. ..... 182/127; 182/141; 182/69.5
(58) Field of Search ..... 182/127, 141, 182/148, 69.5, 69.6; 187/115, 149

(56) References Cited

U.S. PATENT DOCUMENTS

| | | | |
|---|---|---|---|
| 3,664,459 | A | 5/1972 | Stephens et al. |
| 3,701,226 | A | 10/1972 | Fulcher |
| 3,837,427 | A | 9/1974 | Mattinson |
| 4,171,033 | A | 10/1979 | Rust et al. |
| 4,491,449 | A | 1/1985 | Hawkins |
| 5,109,952 | A | 5/1992 | Starks et al. |
| 5,297,653 | A | 3/1994 | Wurtz et al. |
| 5,431,247 | A | 7/1995 | Kishi |
| 5,487,446 | A | 1/1996 | Patnode et al. |
| 5,588,500 | A | 12/1996 | Yonahara |
| 6,044,927 | A | 4/2000 | Newlin |
| 6,158,550 | A | 12/2000 | Arnoldy |

*Primary Examiner*—Hugh B. Thompson, II
(74) *Attorney, Agent, or Firm*—Shlesinger, Arkwright & Garvey LLP

(57) ABSTRACT

Variable height device includes a platform and a lifting mechanism for raising the platform relative to its base. The lifting mechanism may include a scissors lift connected to the platform and a hydraulic cylinder pivotably attached to the scissors lift for raising the platform away from the base. The pivotable attachment of the cylinder may be horizontally and vertically offset from a pivot connection of the scissors lift. A stabilizer may be provided that is sufficiently long to engage a surface on which an all terrain vehicle is located when a base is provided on the device and when the base is mounted on an all terrain vehicle. A ladder may be attached to the platform. An enclosure may at least partially enclose the platform. The base may be configured for being disposed on a bed of a truck.

21 Claims, 7 Drawing Sheets

ADJUSTABLE HEIGHT PLATFORM SUITABLE FOR INSTALLATION ON A VEHICLE

CROSS REFERENCE TO RELATED APPLICATIONS

This application is a Continuation-In-Part of application Ser. No. 09/633,001, filed Aug. 4, 2000, now abandoned, which claims the priority of application Ser. No. 60/194,365, filed Apr. 4, 2000, and which application Ser. No. 09/633,001 claims the priority of application Ser. No. 60/147,391, filed Aug. 6, 1999, and each of which is incorporated herein by reference.

FIELD OF THE INVENTION

This invention relates to variable height platforms. More particularly, the invention relates to variable height platforms suited for installation on vehicles. Even more particularly, the invention relates to variable height platforms suited for installation on vehicles, such as all terrain vehicles (ATVs) and trucks, such as pickup trucks.

BACKGROUND OF THE INVENTION

Fixed height platforms have been known for thousands of years, such as those made from bamboo and wood.

The last hundred years have seen the introduction of metal platforms, particularly those made of soft steels, more recently stainless steels, and most recently aluminum, such as extruded aluminum tubing.

Variable height platforms are now known, such as buckets which are attached to expensive, large arms permanently installed on the bed of a larger vehicle, such as a pick-up truck or commercial service vehicles for working on electrical power lines, for example.

Combination wooden planking and fixed height steel frames are still commonly used in the building trade for painting and during construction of cast concrete commercial structures, for example.

There is a need for an easy-to use, variable height platform which overcomes the drawbacks of the above described fixed and variable height platforms, many of which are unwieldly and relatively heavy.

OBJECTS AND SUMMARY OF THE INVENTION

It is an object of the invention to provide a variable height platform which overcomes the drawbacks of the prior art fixed height and variable height platforms.

Another object of the invention is to provide a variable height platform which is easier to use than known devices.

A still further object of the invention is to provide a variable height platform which is relatively light weight.

Another object of the invention is to provide a variable height platform which is less expensive than known platforms.

A further object of the invention is to provide a variable height platform which can be mounted on a variety of vehicles ranging from all terrain vehicles (ATVs) to pick-up trucks to full size commercial trucks, for example.

Another object of the invention is to provide a liftable platform substantially free of vibration while being raised and lowered.

A yet further object of the invention is to provide a variable height platform which is easy to manufacture, environmentally friendly owing to its reduced use of materials and reduced power requirements, hand-operated without the need for external power sources, has a built-in ladder, may have a fixed operator's seat, is more rigid than known platforms despite the light weight, may have relatively few moving parts, and is easy to use and operate, for example.

In summary, the invention relates to a lift or variable height platform comprising a platform and a lifting mechanism for raising the platform. The lifting mechanism may include a scissors or scissors lift and a hydraulic cylinder or lift arm configured and located for eliminating the undesirable vibration of prior art lifts.

The invention likewise includes the variable height lifts or platforms set forth in the attached claims, as will be readily apparent.

Please note that relative terms such as left, right, up, down, front, and rear are for convenience only and are not meant to be limiting.

DETAILED DESCRIPTION OF THE INVENTION

Figure 1:
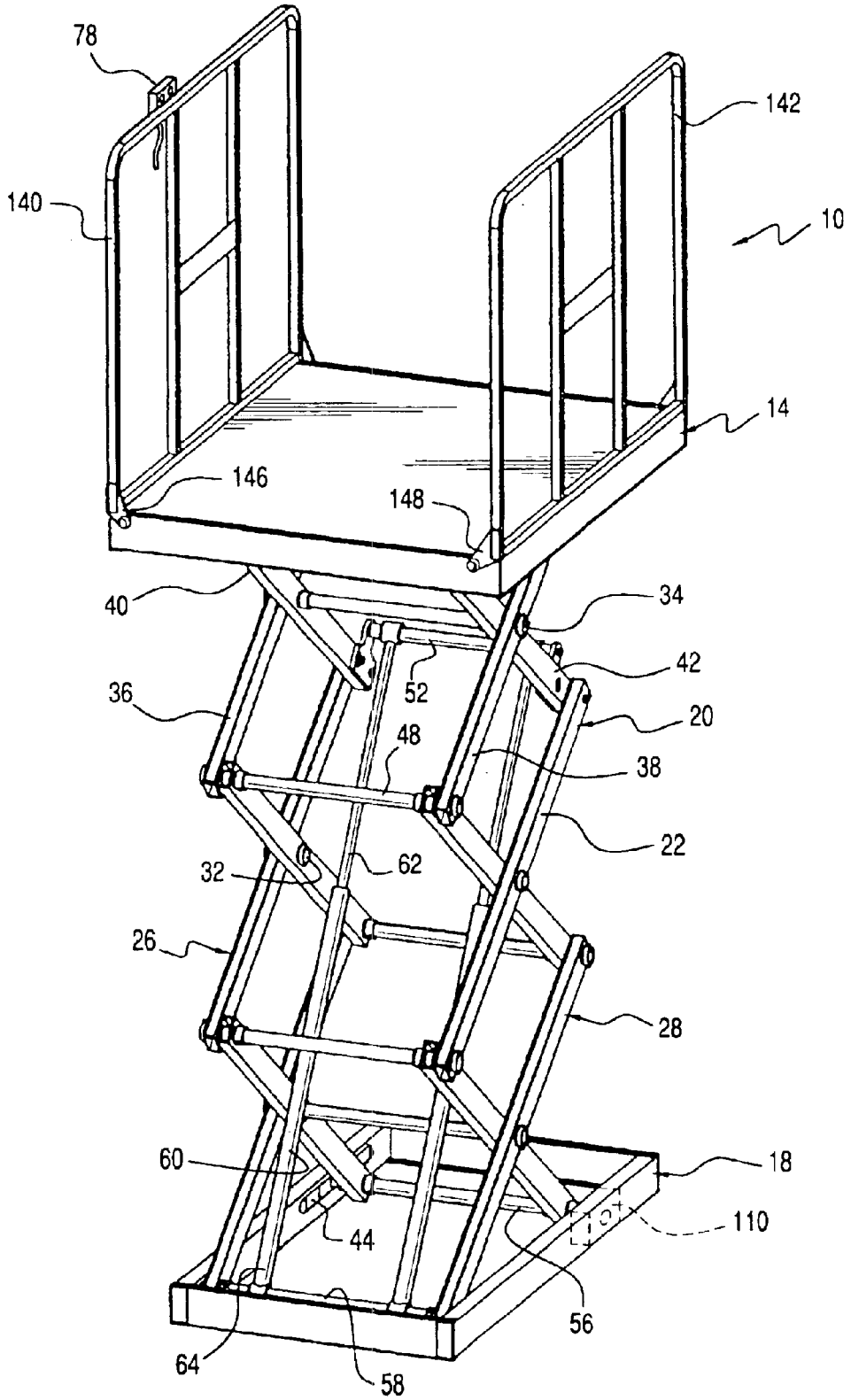
FIG. 1 is a front perspective view of an embodiment of the lift or variable height platform according to the invention.
Figure 2:
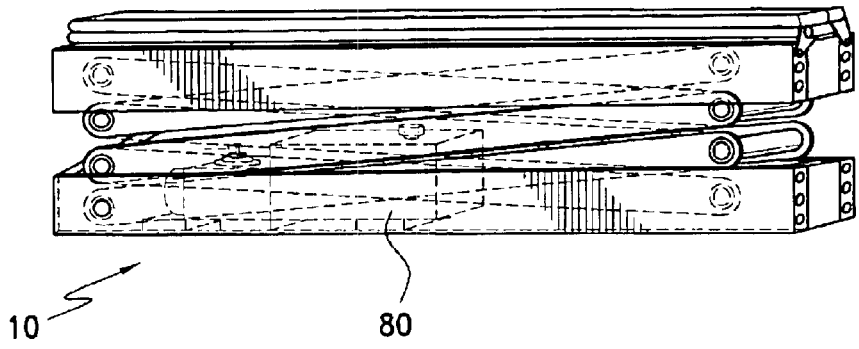
FIG. 2 is a perspective view of the embodiment FIG. 1, shown in a lowered, compact form viewed from the side, with a power unit in place.

FIGS. 1–7 relate, in particular, to an embodiment of the invention.

A variable height lift platform 10 may include a top platform 14 and a spaced apart lower frame or base 18.

A scissors or scissors lift 20 having one or more scissors bars 22 may be provided for varying the height between top platform 14 and lower frame or base 18. There may be a left scissors bar 26 and a right scissors bar 28. Respective left and right pivot connections, such as pins 32 and 34, may be provided on left and right scissors bar 26 and 28. Other pairs of left and right scissors bars 36, 38, 40, 42 may be pinned or pivotably attached, such as by a bolt, to top platform 14 at the respective front rear thereof. At the front thereof, for example, left and right scissors bars 40, 42 may be slidably attached to top platform 14 by respective pins being slidably received in a scissors glide track 54, for example. The optional glide track 54 may be analogous to a glide track 44 defined in base 18.

As will be readily appreciated, each of the other scissors bars 22 may be rotatably pinned together with rivets, pins, bolts, or rods 48 which extend partially or completely from the various pin connections or pivots points of left and right scissors bars 26 and 28.

A strengthening element may be provided in addition to cross bar or rod 48, and may likewise extend between left and right scissors bar 26 and 28. Such a strengthening element may be in the form of a brace or bar which extends parallel or transversely relative to bar 48 and between bars 26 and 28.

An upper glide slot 54 (FIG. 5) may be provided on platform 14 and may receive a respective glide shaft 72 of scissors bar 22 of scissors lift 20.

A push arm 60 may be used for providing a mechanical advantage for raising top platform 14 relative to lower frame 18.

Push arm 60 may include an upper shaft 62 and a lower pivot shaft 64 pivotably attached to lower frame 18. Push arm 60 may likewise include one or more upper free ends 66 on upper shaft 62 for pushing against a fixed or pivotable bar 68 and, hence, raising, left and right scissors bars 26 and 28. As illustrated, upper free end(s) 66 may contact a bearing roller 74 which may be provided near free end 66 on one or both sides for providing a smoother and pivotable contact between push arm 60 and bars 68.

A non-sliding, rotatable or fixed shaft 76 may be provided at the upper free end of scissors bar 42. As shaft 72 slides within glide slot 54, shaft 76 may be held in place.

An optional control unit 78 may be temporarily or permanently provided on platform 14, so that an operator may raise and lower the platform while standing on it. In that manner, no ladder need be provided, as the operator may mount platform 14 in its lowered position, then control the lifting of the platform by himself or herself.

Good results have been achieved when a drive unit 80 is provided on or adjacent lower frame 18. For example, a hydraulic pump 90 may be provided for assisting in raising and lowering top platform 14. An oil tank 94 may be attached to pump 90 in a conventional manner. A hydraulic hose 96 may fluidly connect pump 90 to push arm 60, such as in the case where push arm 60 is a hydraulic cylinder. An electric power unit may be connected to an onboard or outboard source of AC or DC electricity, for example, the DC battery of a vehicle on which lift 20 is provided.

Figure 5:
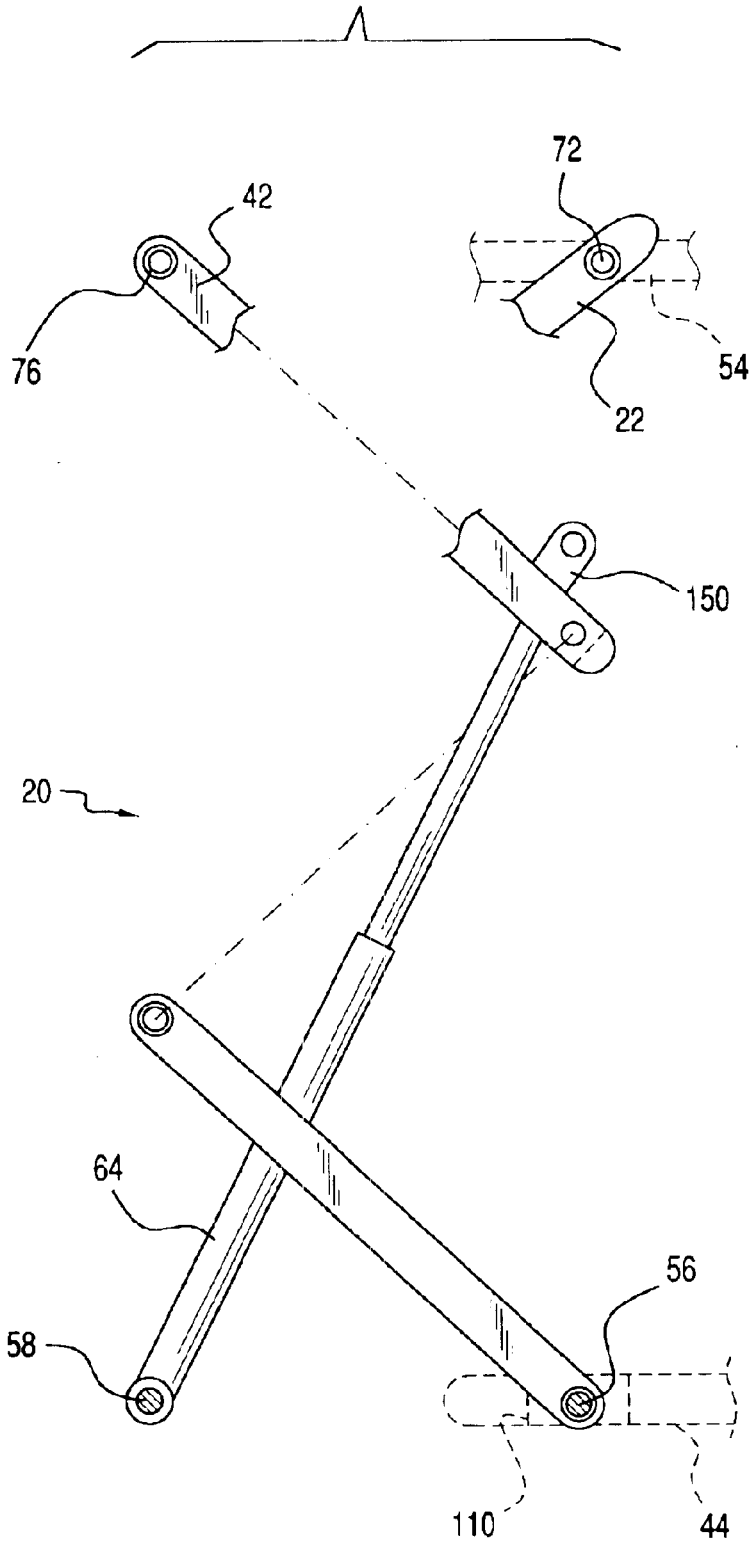
FIG. 5 is a schematic right side partial view of the scissors lift of FIG. 1.
Figure 6:
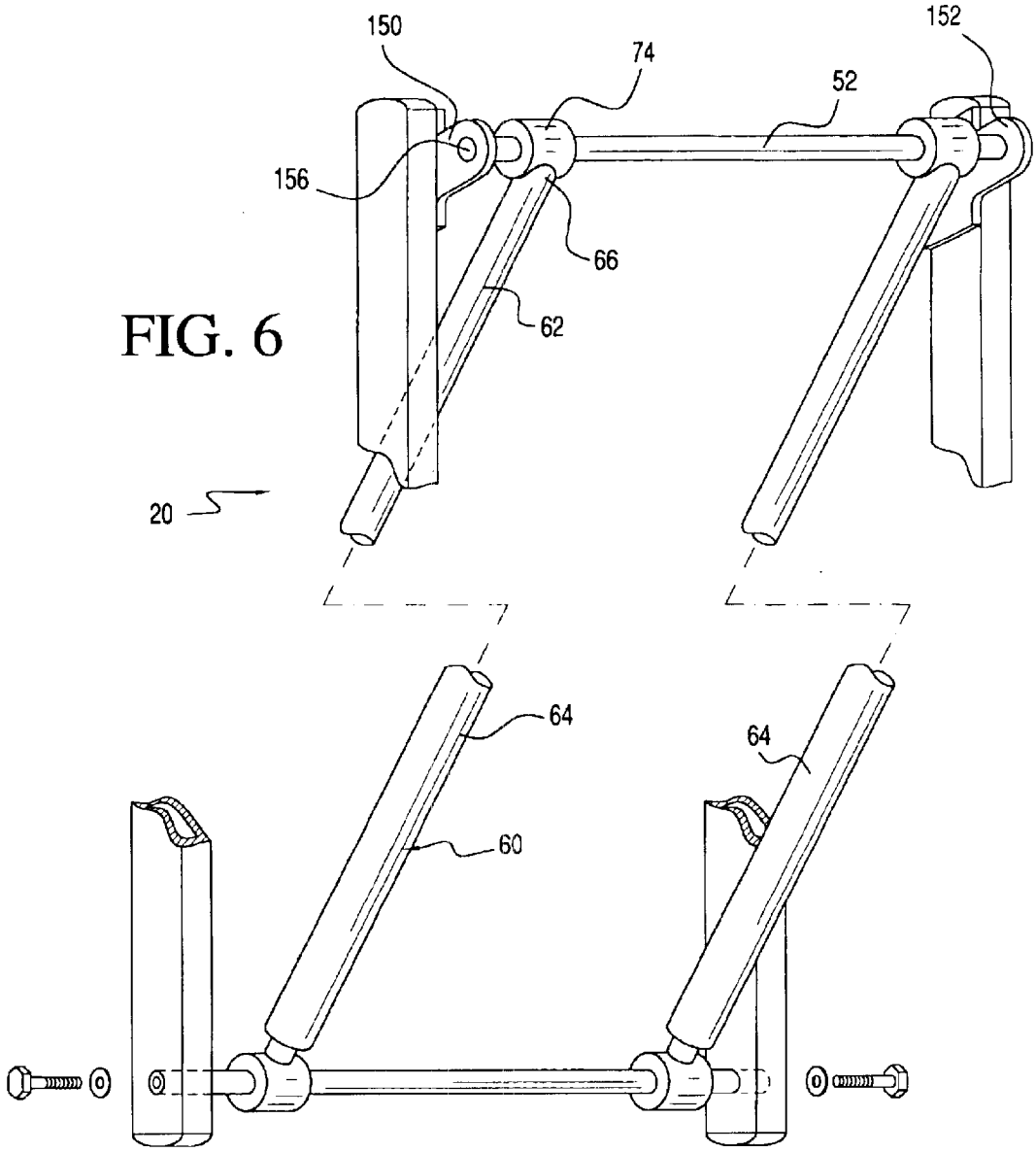
FIG. 6 is a partial front perspective view of the scissors of FIG. 1.
Figure 7:
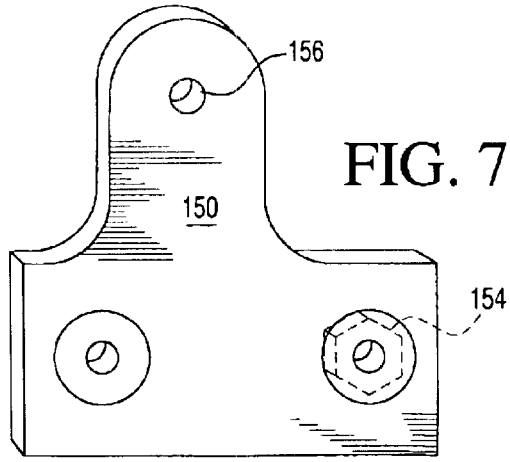
FIG. 7 is an enlarged side view of an offset bracket of the FIG. 1 embodiment.

In that manner, when the user turns on pump 98 in the usual fashion, hydraulic fluid is pressurized, thereby causing one or both of push arms 62 to extend outwardly away from pivot shaft 64, both of which thus rotate in a counterclockwise direction around pivot shaft 58 as viewed in FIGS. 1 and 5, for example. In other words, when push arm 62 extends away from cylinder 64, upper free ends 66 will press against shaft 68 of scissor bars 20, thus causing scissors bars 20 to assume a more vertical position and, hence, raise top platform 14.

Figure 3:
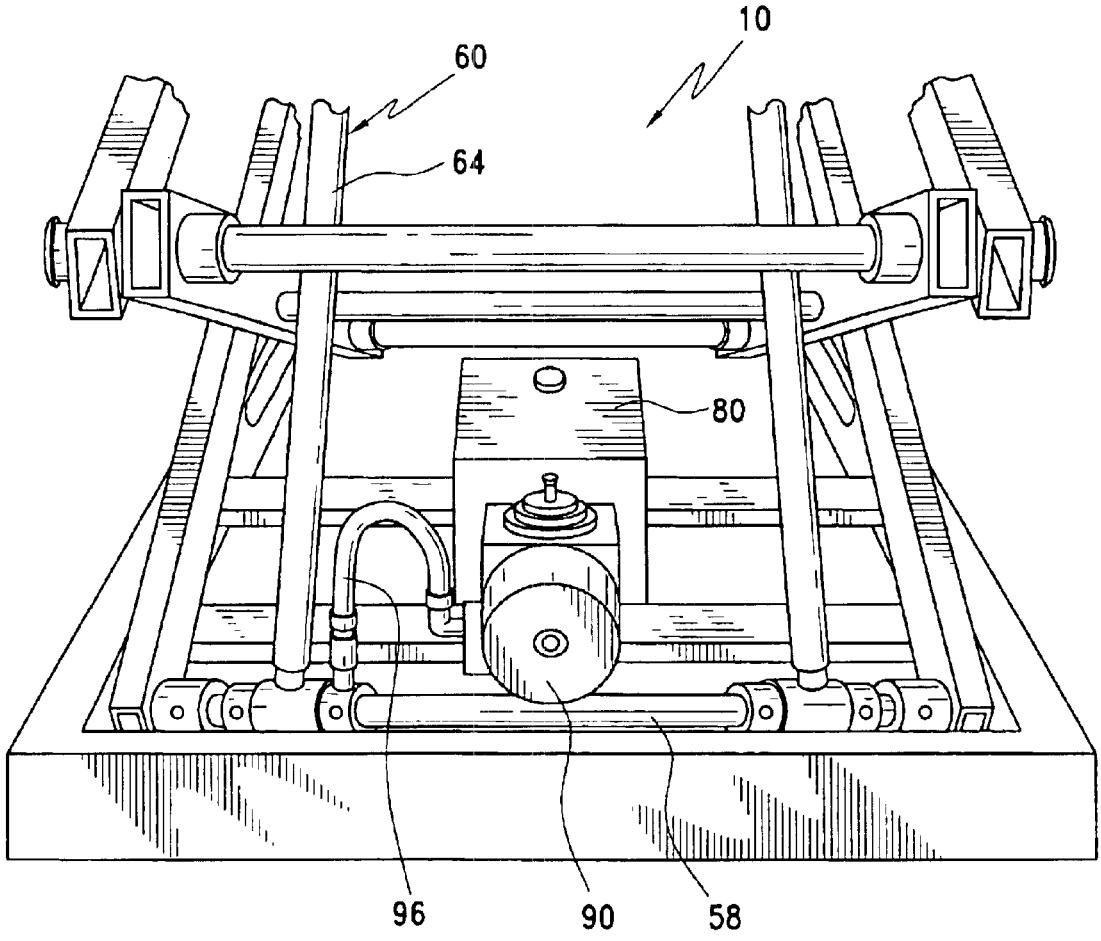
FIG. 3 is a partial front perspective view of a lower portion of the FIG. 1 embodiment in its raised position, with a power unit in place.
Figure 4:
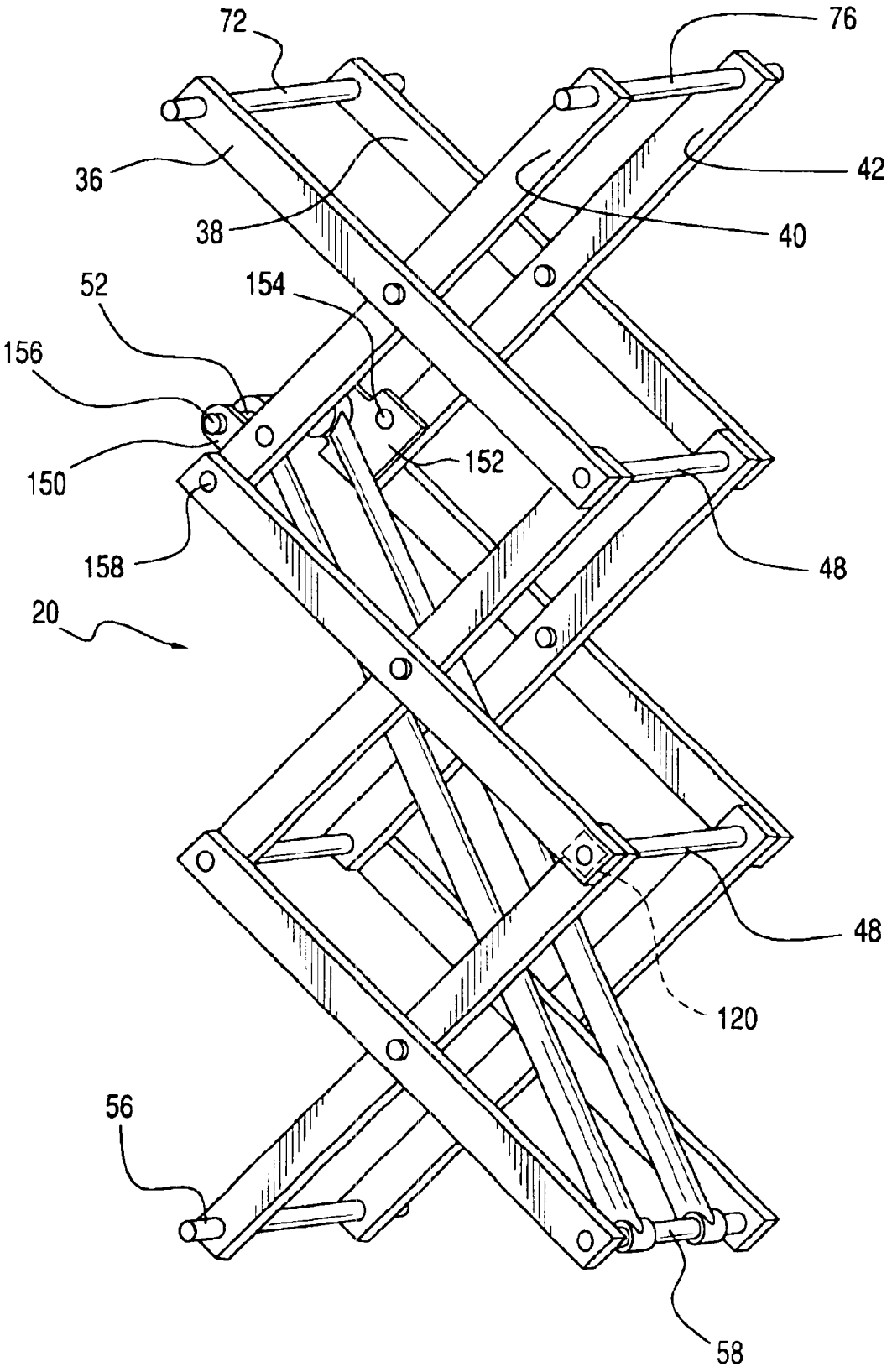
FIG. 4 is a left side perspective view of the scissors lift of the FIG. 1 embodiment, in a raised position.

As will be readily appreciated, when free ends 66 press against shaft 52 of scissor bars 22, glide shaft 56 slides forwardly within scissor glide track 44, as shown in FIGS. 1 and 3 (i.e., to the left as viewed in FIG. 5), thereby causing top platform 14 to move away from lower frame or base 18.

It is further contemplated that a glide shaft be provided having one or more individual glide shafts. Glide shafts 72 and 56 need not extend the entire width from the left to the right side of scissors lift 20.

A glide block 110 may be provided in one or both glide tracks 44 and 54. Glide block 110 may include a hole sized to receive the free ends of shafts 56 and 72, respectively. Lower glide block 110 slides back and forth within track 44 and reduces wear, as it may prevent direct contact between track 44 and shaft 56. Good results have been achieved when glide block 110 has been made of plastic.

Analogous stationary blocks 120 may be provided in one or more of bars 22 for receiving free ends of bars 48, and so forth, for example, a counterpart hole in block 120 may be sized to rotably receive the free ends of bar 48 and serve as plastic bearings.

It is further contemplated that a fixed or collapsible ladder be provided for providing access to platform 14 when platform 14 is in its raised position. A collapsible, detachable ladder may be provided which automatically extends and retracts as platform 14 is raised and lowered, respectively.

One or more hand rails 140, 142 may likewise be provided, as well as a seat which may be a swivel seat. One or both of the hand rails 140, 142 may be hingedly attached to platform 14, such as by respective hinges 146, 148, so that they may be folded down during transport or shipping.

One or more mounting brackets 150 and 152 may be provided on scissors lift 20 for securing pivot shaft 52.

One or both of brackets 150 and 152 may be secured by use of rivets, pins, welds, or bolts 154. A pivot point 156, such a through hole, receives respective free ends of-shaft 52.

Although shaft 52 could be secured at a pin connection 158, good results have been achieved when pin connection 156 is used. It has been found that by offsetting pin connection 156 by one or both of horizontally or vertically relative to pin connection 158, a smoother, substantially vibration-free extension of lift 20 from its lowered position to its raised position has been achieved. Smoother, substantially vibration-free lowering of platform 14 relative to base 18 has likewise been achieved, thanks to the vertical and horizontal offset of connection 156 relative to pivot point 158.

Offset bracket 150 has successfully substantially eliminated the vibration which the lift mechanism would otherwise experience owing to the use of a hydraulic system; i.e., a hydraulic cylinder 60, pump 90, and associated parts. Good results have likewise been achieved when free end 66 of lift arm 62 is disposed a few degrees higher than the end of arm 64 which is pinned to shaft 58, when push arm 60 is in its retracted position corresponding to the folded up or lowered position of lift 10, shown in FIG. 2. For example, if the horizontal offset between shaft 58 and shaft 52 is about 48 inches when lift 10 is in its lowered position of FIG. 2, and shaft 52 is about four inches higher than shaft 58, extension of lift arm 65 away from push arm 64, such as in the case where arm 60 is a hydraulic cylinder/piston combination, is made smoother.

In the case where bracket 150 is bolted on by use of bolt 154, bracket 150 may be readily replaced should bracket 150 become one by unbolting the one or more bolts 154, and then slipping bracket 150 off the free end of shaft 52, followed by replacement with a new bracket 150, and rebolting on the new bracket 150. No further disassembly and assembly need be required.

Figure 8:
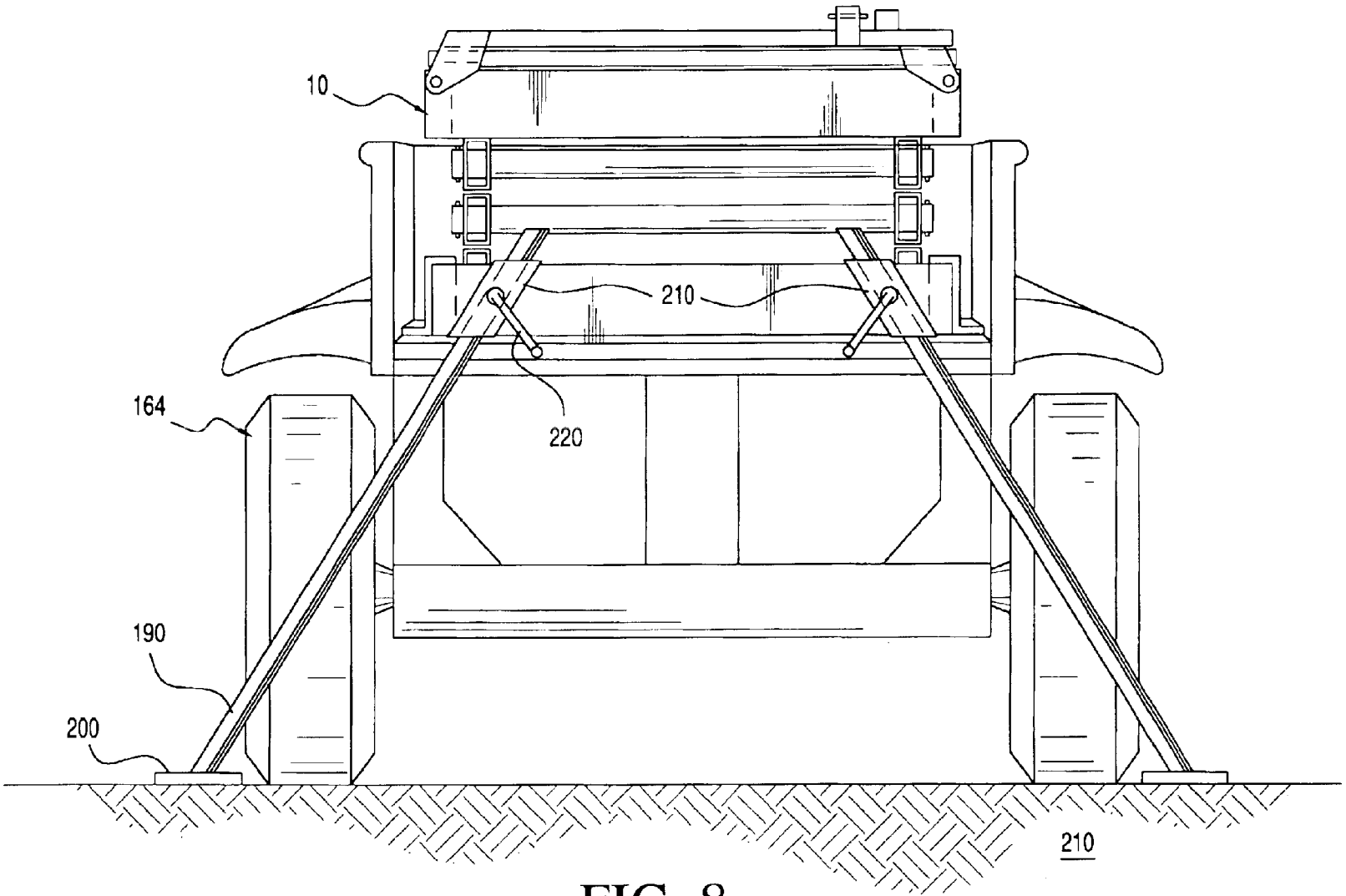
FIG. 8 is rear perspective view of a variable height platform mounted on a vehicle, such as an all terrain vehicle (ATV)
Figure 9:
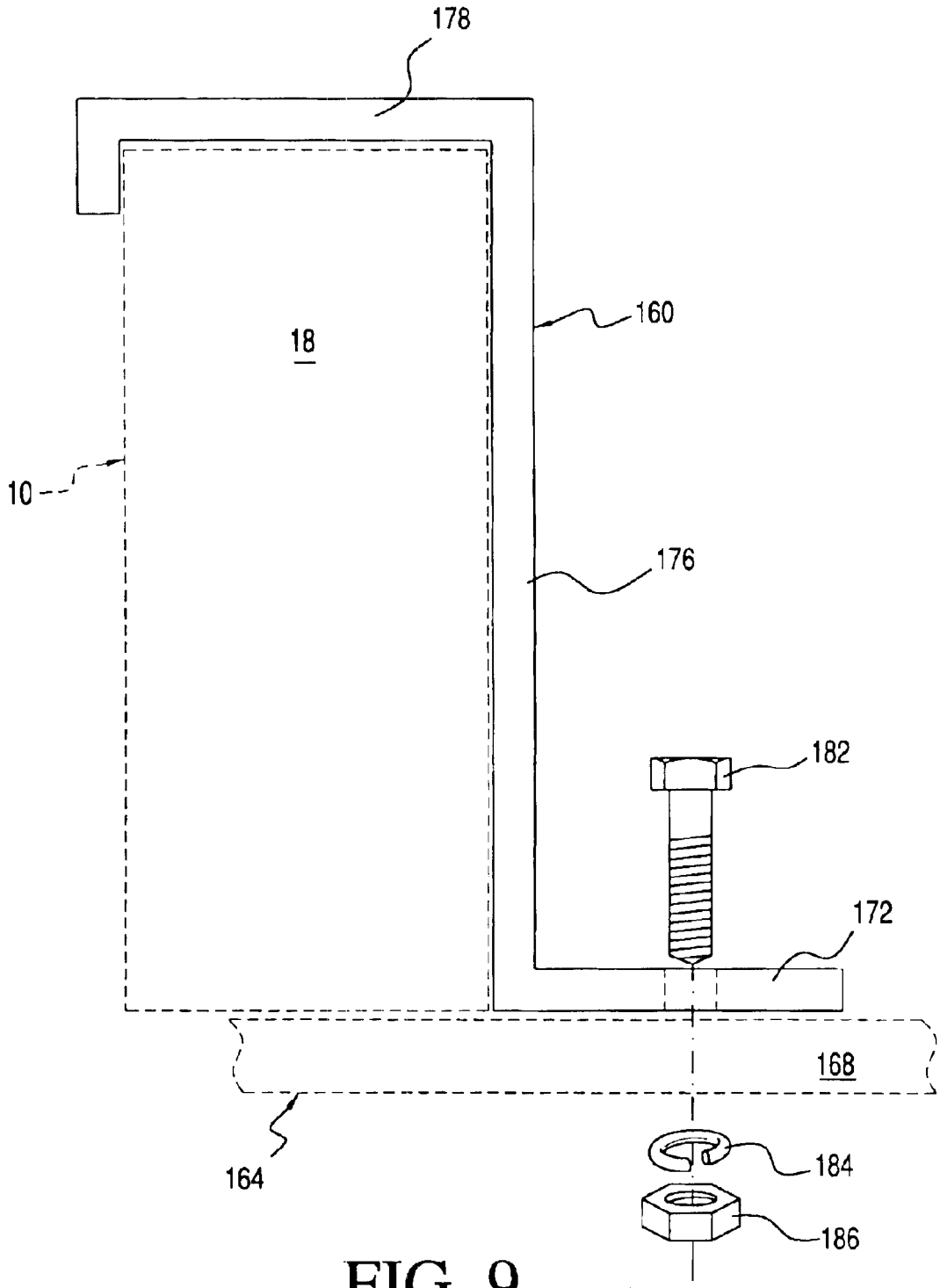
FIG. 9 is a partial, exploded sectional view of FIG. 8, on an enlarged scale, showing the manner in which the adjustable height lift may be mounted to a vehicle.

FIGS. 8 and 9 illustrate that one or more mounting brackets 160 may be provided by which lift 10 is attachable to a vehicle 64, such as a truck or ATV.

FIGS. 8 and 9 illustrate variable height lift platform 10 mounted on a vehicle such as on all terrain vehicle (ATV) or the illustrated utility vehicle 164, commonly known as a club car, such as a John Deere® Gator® brand utility vehicle having a bed 168, as shown. Lift platform 10 may be mounted for stationary use at a desired location, or on any other object such as a utility van, farm tractor, pickup truck, fork lift, and so forth.

FIG. 9 illustrates mounting bracket 160 such as viewed on the right side of FIG. 8, on an enlarged scale.

Mounting bracket 160 may include a base 172, an upright 176 and an extension 178 configured for securing and retaining base 18 of lift 10.

Mounting bracket 160 may be secured to vehicle 164, such as by use of a bolt 182 attaching leg 172 to floor 168 of the vehicle 164. As shown, bolt 182 may be detachably attached by use of a lock washer 184 and a nut 186.

One or more stabilizers 190 may be provided for use when lift 10 is mounted on an ATV for example. In that case, at least one of the stabilizers 190 will be extended until a foot 200 engages a surface 210 such as the ground, while lift 10 remains on the ATV, for example.

Once stabilizer foot 200 has engaged the surface 210 on which the ATV is located, the disposition (i.e., the effective set length of stabilizer 190) is fixed. That is, the effective length is set by securing the stabilizer 190 in place by use of a clamp 220 or a wing nut, locking pin, or the like securing a fixed element 230 to stabilizer 190.

It will thus be seen that the lift or variable height platform 10 according to the invention is particularly suited for use by farmers, lifeguards, movie camera operators, painters, maintenance crews, and other occupations.

The push arm 60 may be made of iron or stainless steel, and all the other components may be made of aluminum, such as extruded aluminum tubing, or stainless steel components. The aluminum may be aircraft grade aluminum for the scissors lift components, and aluminum may be used for the fasteners and pins.

A sliding ladder may be made in a manner similar to a conventional aluminum extension ladder or a telescoping ladder.

It is contemplated that pins or locking elements need not be provided to lock the top platform 14 in position.

The valving and size of the hydraulic system may be selected so that a smooth ascent and descent are achieved. The hydraulic system may be configured so that the hydraulic pressure fixes or locks platform 14 in place. The hydraulic pump may be Model No. M3519-12Volt, as supplied by Monarch Hydraulics, Inc. of Grand Rapids, Michigan 49503.

Pin(s) or locking device(s) may be provided to go through a portion of an optional telescoping or sliding ladder to lock it in position in a similar manner.

Another feature may be the provision of a screw or winch which may be used in addition to or instead of the hydraulic jack used to raise and lower the scissors mechanism of the embodiment described above.

It is expected that any of the embodiments may be made of a variety of materials suitable for the intended purpose and functions set forth above.

While this invention has been described as having a preferred design, it is understood that it is capable of further modifications, and uses and/or adaptations of the invention and following in general the principle of the invention and including such departures from the present disclosure as come within the known or customary practice in the art to which the invention pertains, and as may be applied to the central features hereinbefore set forth, and fall within the scope of the invention or limits of the claims appended hereto.

What is claimed is:

1. A variable height device, comprising:

a) a platform and a base;

b) a lifting mechanism provided for raising the platform upwardly away from the base;

c) the lifting mechanism including a scissors lift located between the platform and the base;

d) the scissors lift including an upper arm and a pivotably attached lower arm, the upper and lower arms being attached at a pivot connection;

e) a push arm provided on the lifting mechanism;

f) the push arm engaging the scissors lift for raising the platform;

g) the push arm having a lower end and an upper end, the lower end being pivotably attached to the base, and the upper end being pivotably attached at an upper push arm pivot, the upper push arm pivot being located adjacent the pivot connection of the scissors lift; and h) the upper push arm pivot being vertically offset from the pivot connection of the scissors lift, the upper push arm pivot being located for substantially reducing vibration of the variable height device when the scissors lift is raised by the push arm.

2. The device as in claim 1, wherein:

a) the upper push arm pivot is horizontally offset from the pivot connection of the scissors lift.

3. The device as in claim 2, wherein:

a) a bracket is provided between the pivot connection and the upper push arm pivot.

4. The device as in claim 3, wherein:

a) the bracket is attached to a link of the scissors lift.

5. The device as in claim 4, wherein:

a) the upper push arm pivot is located on the bracket.

6. The device as in claim 5, wherein:

a) the pivot connection is located on the bracket.

7. The device as in claim 2, wherein:

a) the lifting mechanism includes at least two scissors lifts connected to the platform.

8. The device as in claim 1, wherein:

a) a glide track is provided adjacent the base; and b) the scissors lift engages the glide track.

9. The device as in claim 8, wherein:

a) the glide track is disposed within the platform.

10. The device as in claim 8, wherein:

a) the glide track guides vertical movement of the platform relative to the base.

11. The device as in claim 8, wherein:

a) a further glide track is provided adjacent the platform; and b) the scissors lift engages the further glide track.

12. The device as in claim 8, wherein:

a) a glide block is slidably received within the glide track; and b) the scissors lift engages the glide block.

13. The device as in claim 1, wherein:

a) a power unit engages the push arm.

14. The device as in claim 13, wherein:

a) the power unit includes a hydraulic cylinder.

15. The device as in claim 1, wherein:

a) a bracket is provided between the pivot connection and the upper push arm pivot.

16. The device as in claim 1, wherein:

a) the base is configured for being attached to a vehicle.

17. The device as in claim 16, wherein:

a) a mounting bracket is provided, the mounting bracket being configured for attaching the base to a bed of a vehicle.

18. The device as in claim 1, wherein:

a) the base is configured for being attached to an all terrain vehicle.

19. The device as in claim 18, wherein:

a) a stabilizer is provided for stabilizing the base.

20. The device as in claim 19, wherein:

a) the stabilizer includes left and right stabilizers.

21. The device as in claim 20 wherein:

a) at least one of the left and right stabilizers is sufficiently long to engage a surface on which an all terrain vehicle is located when the base is mounted on an all terrain vehicle.

* * * * *